US007967614B1

(12) United States Patent
Cina et al.

(10) Patent No.: US 7,967,614 B1
(45) Date of Patent: Jun. 28, 2011

(54) PLUG CONNECTOR AND CONNECTOR ASSEMBLY HAVING A PLUGGABLE BOARD SUBSTRATE

(75) Inventors: Michael Frank Cina, Elizabethtown, PA (US); Randall Robert Henry, Harrisburg, PA (US); Linda Ellen Shields, Camp Hill, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/769,305

(22) Filed: Apr. 28, 2010

(51) Int. Cl.
*H01R 24/00* (2006.01)

(52) U.S. Cl. ..... 439/76.1; 439/941

(58) Field of Classification Search ..... 439/76.1, 439/941

See application file for complete search history.

(56) References Cited

U.S. PATENT DOCUMENTS 5,766,027 A 6/1998 Fogg
5,971,812 A 10/1999 Martin
5,997,358 A * 12/1999 Adriaenssens et al. ..... 439/676
6,113,400 A 9/2000 Martin et al.
6,116,943 A 9/2000 Ferrill et al.
6,354,865 B1 3/2002 Bogese
6,561,838 B1 5/2003 Blichfeldt
7,201,618 B2 * 4/2007 Ellis et al. ..... 439/676
7,204,722 B2 * 4/2007 Hashim et al. ..... 439/676
7,244,126 B2 7/2007 Morana et al.
7,314,393 B2 * 1/2008 Hashim ..... 439/676
7,320,624 B2 * 1/2008 Hashim et al. ..... 439/676
7,322,860 B2 1/2008 Martich et al.
7,474,737 B2 1/2009 Crudele et al.
7,618,262 B2 * 11/2009 Fogg et al. ..... 439/65
2006/0160428 A1 * 7/2006 Hashim ..... 439/676

* cited by examiner

*Primary Examiner* — Gary F. Paumen

(57) ABSTRACT

A plug connector having a plug body including a board substrate. The board substrate has at least one engagement surface that is configured to interface with mating contacts of a receptacle connector. The plug connector also includes a plurality of differential pairs that extend along the board substrate. The differential pairs include conductive pathways that have contact pads located on said at least one engagement surface. The contact pads are configured to electrically engage the mating contacts of the receptacle connector. The conductive pathways of at least one differential pair form a cross-over such that the conductive pathways of the plurality of differential pairs have a first arrangement with respect to each other before the cross-over and a different second arrangement after the cross-over. The first and second arrangements generate first and second crosstalk components, respectively, that are configured to offset one another.

22 Claims, 5 Drawing Sheets

PLUG CONNECTOR AND CONNECTOR ASSEMBLY HAVING A PLUGGABLE BOARD SUBSTRATE

BACKGROUND OF THE INVENTION

The subject matter herein relates generally to electrical connector assemblies that include mateable plug and receptacle connectors, and more particularly, to such connector assemblies that are configured to reduce crosstalk and/or reduce return loss.

In the electronics industry, and in particular the telecommunications industry, there are increasing trends toward smaller electrical connectors and electrical connectors that can accommodate faster transmission speeds. In some cases, when electrical connectors are made smaller, the conductive pathways are brought closer to each other thereby increasing the electromagnetic coupling between the conductive pathways. An increase in electromagnetic coupling may generate unwanted noise or crosstalk that negatively affects the performance of the electrical connector.

Some conventional connector assemblies include a plug connector that is configured to be inserted into and pluggably engage a receptacle connector. In one such connector assembly, a plug connector includes a pluggable board substrate having a rectangular, printed-circuit-board (PCB) body with plug contacts. When the board substrate is inserted into a cavity of a receptacle connector, the board substrate engages mating contacts of the receptacle connector. The mating contacts electrically engage the plug contacts of the plug connector to establish a communicative connection. However, the board substrate of the plug connector may have limited capabilities for reducing unwanted crosstalk and/or for reducing return loss.

Accordingly, there is a need for connector assemblies and plug connectors having pluggable board substrates that are configured to at least one of reduce crosstalk and reduce return loss.

BRIEF DESCRIPTION OF THE INVENTION

In one embodiment, a plug connector having a plug body including a board substrate is provided. The board substrate has at least one engagement surface that is configured to interface with mating contacts of a receptacle connector. The plug connector also includes a plurality of differential pairs that extend along the board substrate. The differential pairs include conductive pathways that have contact pads located on said at least one engagement surface. The contact pads are configured to electrically engage the mating contacts of the receptacle connector. The conductive pathways of at least one differential pair form a cross-over such that the conductive pathways of the plurality of differential pairs have a first arrangement with respect to each other before the cross-over and a different second arrangement after the cross-over. The first arrangement of conductive pathways generates a first crosstalk component and the second arrangement of conductive pathways generates a second crosstalk component when signal current flows through the conductive pathways. The first and second crosstalk components at least partially offset one another.

Optionally, the engagement surface is a first engagement surface and the board substrate also includes a second engagement surface. The first and second engagement surfaces may face in opposite directions and have a thickness of the board substrate defined therebetween. The differential pairs of conductive pathways may form a first set of differential pairs that extend generally along the first engagement surface and a second set of differential pairs that extend generally along the second engagement surface. Optionally, the first and second sets of differential pairs electromagnetically couple with each other through the thickness thereby affecting magnitudes of the first and second crosstalk components. Furthermore, the first and second sets of differential pairs may have substantially matching patterns of conductive pathways along the first and second engagement surfaces.

In another embodiment, a connector assembly is provided that includes a receptacle connector having a plurality of mating contacts including corresponding contact heads. The connector assembly also includes a plug connector that is configured to mate with the receptacle connector. The plug connector has a plug body including a board substrate. The board substrate has at least one engagement surface that is configured to interface with the mating contacts of the receptacle connector. The plug connector also includes a plurality of differential pairs that extend along the board substrate. The differential pairs include conductive pathways that have contact pads located on said at least one engagement surface. The contact pads are configured to electrically engage the mating contacts. The conductive pathways of at least one differential pair form a cross-over such that the conductive pathways of the plurality of differential pairs have a first arrangement with respect to each other before the cross-over and a different second arrangement after the cross-over. The first arrangement of conductive pathways generates a first crosstalk component and the second arrangement of conductive pathways generates a second crosstalk component when signal current flows through the conductive pathways. The first and second crosstalk components at least partially offset one another.

DETAILED DESCRIPTION OF THE INVENTION

Figure 1:
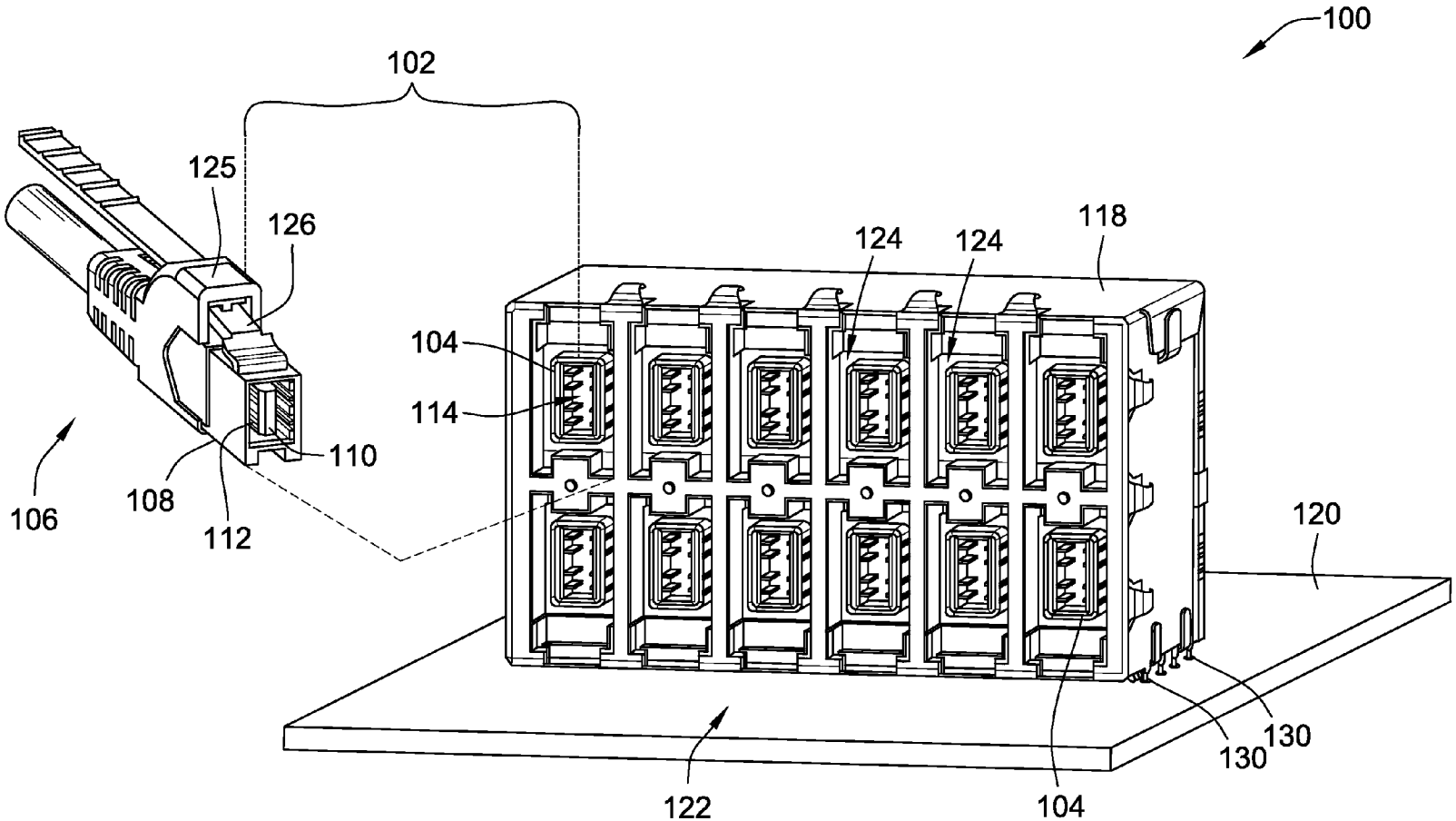
FIG. 1 is a perspective view of an exemplary electrical system including connector assemblies formed in accordance with an embodiment.

FIG. 1 is a perspective view of an electrical system 100 formed in accordance with an exemplary embodiment. The electrical system 100 includes a plurality of connector assemblies 102 that each include a first or receptacle connector 104 and a mateable second or plug connector 106. (For illustrative purposes, only one plug connector 106 is shown in FIG. 1.) The plug and receptacle connectors 106 and 104 are configured to engage each other during a mating operation and form a pluggable engagement. The electrical system 100 also includes a system housing 118 having an array 122 of the receptacle connectors 104. The system housing 118 may be mounted to another electrical component, such as a circuit board 120. The receptacle connectors 104 may be communicative coupled to the circuit board 120.

As shown, the plug connector 106 has a plug body 108 and a pluggable board substrate 110 having plug contacts 112 thereon. The receptacle connector 104 includes mating contacts 114 that electrically couple to the corresponding plug contacts 112 when the plug and receptacle connectors 106 and 104 are pluggably engaged. The plug and receptacle connectors 106 and 104 may be modular connectors, such as the types of electrical connectors used for connecting telecommunications equipment or computer networking equipment. In the exemplary embodiment, the board substrate 110 is configured to improve a performance of the connector assembly 102 by, for example, reducing effects of unwanted crosstalk and reducing return loss.

In the illustrated embodiment, the plug and receptacle connectors 106 and 104 are eight pin, eight conductor (8P8C) modular connectors having differential pairs configured to transmit data signals therethrough. However, the subject matter described herein is not limited to the illustrated embodiment and may also have applicability to other connectors having fewer or greater numbers of pins, conductors, and/or differential pairs. Additionally, the subject matter described herein may also be applicable to other types of connectors used within the telecommunications industry and to other types of connectors used in other industries, such as the computer industry, such as connectors for interfacing devices, like USB connectors, SFP connectors, and the like.

Embodiments described herein may be used for high-speed data transfer. For example, in some embodiments, a data transfer rate of the connector assembly 102 is greater than about 1 gigabits/s. In particular embodiments, the data transfer rate of the connector assembly 102 is greater than about 5 gigabits/s and, more particularly, greater than or equal to about 10 gigabits/s. However, embodiments described herein are not limited to high-speed connector assemblies and may be used in various types of connector assemblies.

As shown, the system housing 118 holds the array 122 of receptacle connectors 104 and includes respective ports or openings that lead into corresponding cavities 124. Each cavity 124 is configured to house a corresponding receptacle connector 104 therein. For example, each cavity 124 may be sized and shaped to receive the plug body 108 and direct the plug body 108 to pluggably engage the receptacle connector 104. In the illustrated embodiment, the mating contacts 114 and the plug contacts 112 are arranged in similar patterns for mating engagement. In some embodiments, the mating contacts 114 and the plug contacts 112 are arranged, or grouped, as differential pairs. Also shown, the plug connector 106 may include a latch 126 on an exterior surface thereof for securing the plug connector 106 within the cavity 124 when the plug body 108 is inserted therein. The plug connector 106 may also include a jacket 125 that covers at least a portion of the plug body 108.

The system housing 118 may comprise a conductive material and define a shield, such as an electromagnetic interference (EMI) shield. The system housing 118 may include mounting tabs 130 for mounting to the circuit board 120. For example, the mounting tabs 130 may be eye-of-the-needle pins that are pressed into the circuit board 120 for mechanically and electrically connecting the system housing 118 to the circuit board 120.

Figure 2:
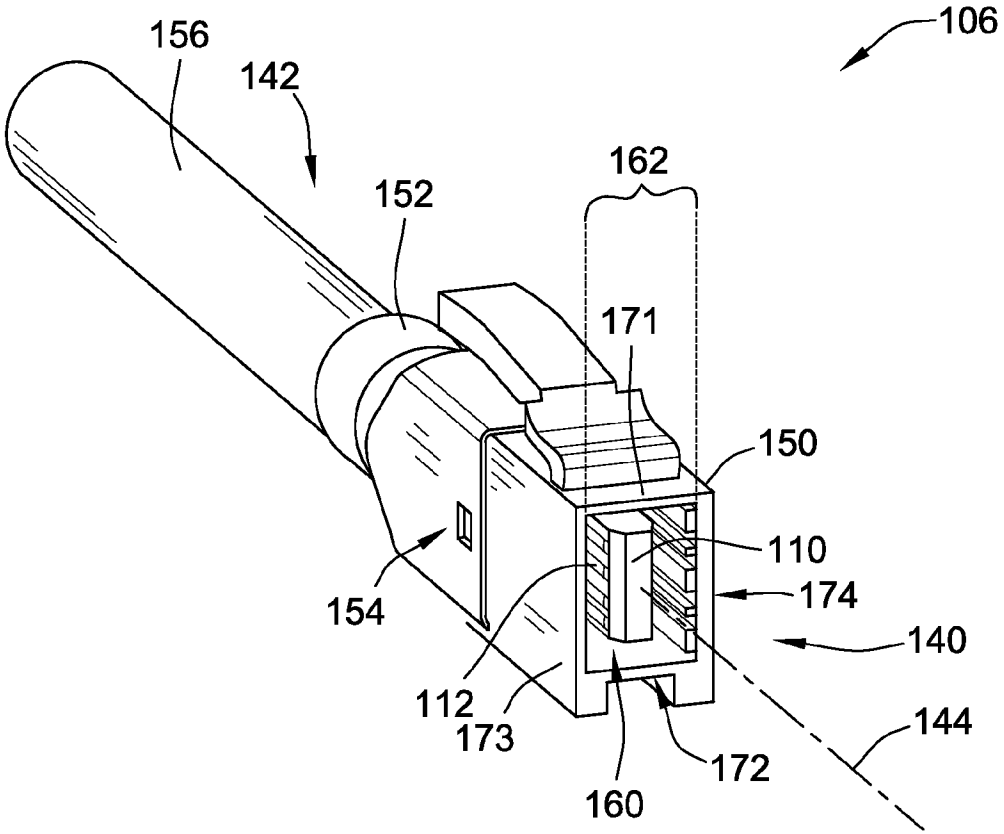
FIG. 2 is a perspective view of a plug connector formed in accordance with one embodiment.

FIG. 2 is a perspective view of the plug connector 106. For illustrative purposes the jacket 125 (shown in FIG. 1) has been removed. The plug connector 106 has a mating end 140 and a cable end 142 and a longitudinal axis 144 extending therebetween. The plug body 108 includes a plug housing 150 and a ferrule 152 extending from the plug housing 150. The ferrule 152 is coupled to the plug housing 150 using a latching mechanism 154 or other type of fastener. The ferrule 152 surrounds a cable 156 and the individual conductors 246 (shown in FIG. 3) that form the cable 156. The ferrule 152 is securely coupled to the cable 156 to resist removal of the cable 156 from the plug body 108.

The plug housing 150 includes walls 171-174 that define an opening 162 leading into a cavity 160 of the plug housing 150. The board substrate 110 and the plug contacts 112 are provided within the cavity 160 for interfacing with the mating contacts 114 (FIG. 1) of the receptacle connector 104 (FIG. 1). The walls 171-173 extend between the mating end 140 and the cable end 142 of the plug housing 150. In an exemplary embodiment, the walls 171-174 include a top wall 171, a bottom wall 172, and opposite side walls 173 and 174. However, the plug body 108 may have various configurations and shapes in alternative embodiments. In some embodiments, the plug housing 150 is fabricated from a non-conductive material, such as plastic, and is molded into form.

As shown in FIG. 2, the board substrate 110 may be held in a fixed orientation with respect to the walls 171-174. When the plug connector 106 is engaged with the receptacle connector 104, the plug body 108 is moved in a mating direction (i.e., in a direction along the longitudinal axis 144) and the board substrate 110 is received by the mating contacts 114 of the receptacle connector 104. In the exemplary embodiment, the board substrate 110 is located within the cavity 160 such that the board substrate 110 is surrounded by the walls 171-174 and does not project beyond the opening 162. However, in alternative embodiments, the board substrate 110 may project beyond the opening 162. Furthermore, in alternative embodiments, the plug body 108 does not include the walls 171-174 and the board substrate 110 is exposed to the surrounding environment. In such embodiments, the board substrate 110 may be inserted within a corresponding cavity of the receptacle connector.

Figure 3:
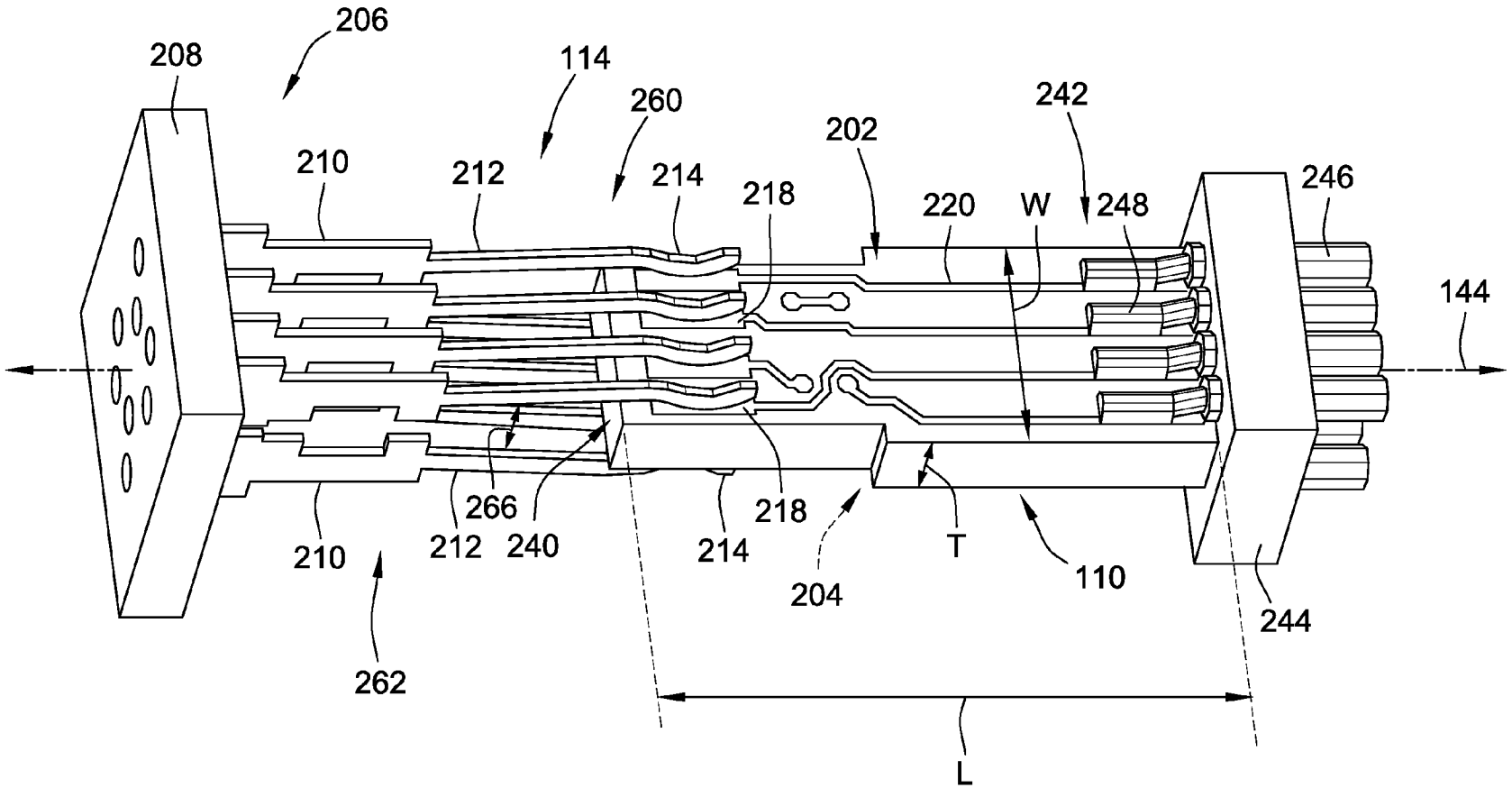
FIG. 3 is a perspective view of mating contacts of a receptacle connector interfacing a board substrate of the plug connector of FIG. 2.

FIG. 3 is a perspective view of the mating contacts 114 of the receptacle connector 104 (FIG. 1) electrically engaged to the board substrate 110 of the plug connector 106 (FIG. 1). The board substrate 110 may be similar to, for example, a printed circuit board (PCB) and may be manufactured in similar manners. For example, the board substrate 110 may comprise a plurality of dielectric non-conductive layers where a plurality of traces (or trace portions) are deposited and connecting vias (or plated thru-holes) are formed. As shown, the board substrate 110 has a pluggable end 240 and a loading end 242 that are separated from each other by a length L of the board substrate 110. The length L is measured along the longitudinal axis 144. In the illustrated embodiment, the board substrate 110 has an elongated and substantially rectangular shape. However, in alternative embodiments, the board substrate 110 may have other shapes. For example, the plug connector 106 may form a right-angle type connector such that the pluggable and loading ends 240 and 242 are not opposite each other. In such embodiments, the board substrate 110 may have an L-shape. Also shown in FIG. 3, the board substrate 110 has a width W that extends perpendicular to the longitudinal axis 144.

Figure 5:
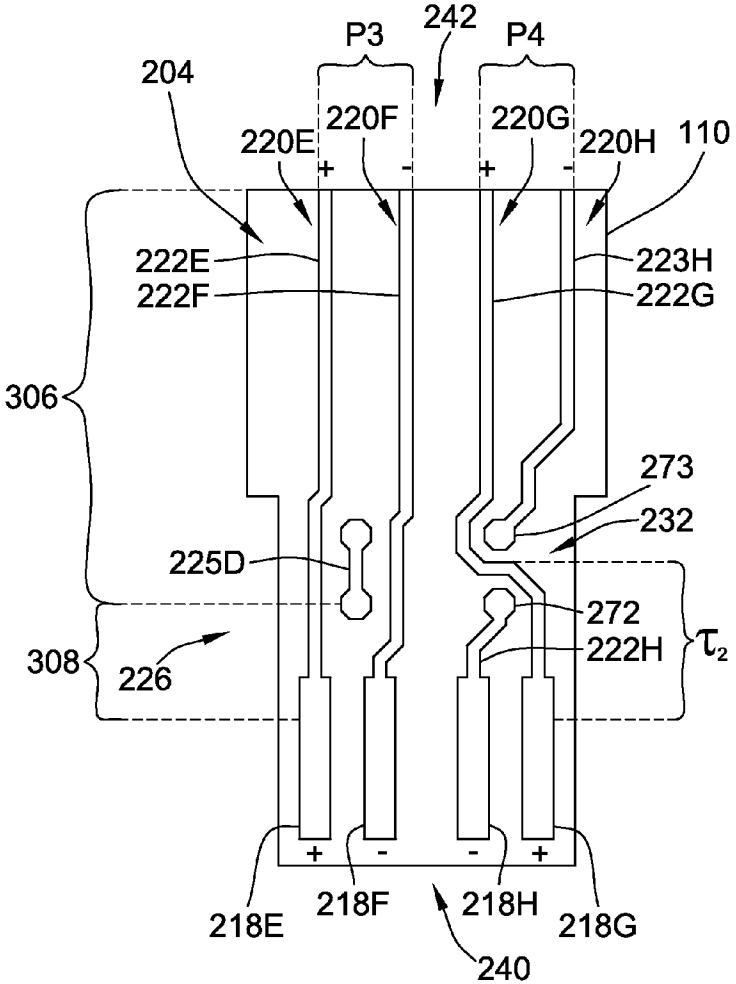
FIG. 5 is a plan view of a second engagement surface of the board substrate of FIG. 3.

The board substrate 110 may include first and second engagement surfaces 202 and 204 that are configured to interface with the mating contacts 114. The first and second engagement surfaces 202 and 204 may face in opposite directions. A thickness T of the board substrate 110 may be defined between the first and second engagement surfaces 202 and 204. The board substrate 110 also includes a plurality of contact pads 218 located on the engagement surfaces 202 and 204 proximate to the pluggable end 240 of the board substrate 110. (The contact pads 218 of the engagement surface 204 are shown in FIG. 5). The contact pads 218 may form the plug contacts 112 (FIG. 1) of the plug connector 106.

The receptacle connector 104 may include a contact subassembly 206 having a contact organizer 208 that is electrically and mechanically coupled to the mating contacts 114. The mating contacts 114 may be communicatively coupled to other conductive pathways (not shown) through the contact organizer 208. As shown, each mating contact 114 includes a base portion 210 that is mechanically coupled to the contact organizer 208 and a corresponding beam portion 212 that extends away from the base portion 210. Each beam portion 212 includes a corresponding contact head 214 that is configured to interface with the board substrate 110 and, more specifically, configured to electrically engage a corresponding contact pad 218.

In the illustrated embodiment, the mating contacts 114 may be arranged with respect to each other to form first and second sets 260 and 262. The mating contacts 114 of the first set 260 may be aligned side-by-side with each other such that the contact heads 214 of the first set 260 of mating contacts 114 face a common direction. Likewise, the mating contacts 114 of the second set 262 may be aligned side-by-side with each other and the corresponding contact heads 214 of the second set 262 may face a common direction. The first set 260 of mating contacts 114 is configured to electrically engage the contact pads 218 of the first engagement surface 202, and the second set 262 of mating contacts 114 is configured to electrically engage the contact pads 218 of the second engagement surface 204. In the exemplary embodiment, the contact heads 214 of the first and second sets 260 and 262 face each other and are spaced apart from each other by a contact separation 266. The contact separation 266 may be less than the thickness T of the board substrate 110.

Also shown in FIG. 3, the contact heads 214 of the mating contacts 114 may be shaped to facilitate engaging or interfacing with the pluggable end 240 of the board substrate 110 when the plug and receptacle connectors 106 and 104 are mated. For example, the contact heads 214 may be shaped to curve away from the board substrate 110. In the exemplary embodiment, when the plug and receptacle connectors 106 and 104 are electrically engaged, the board substrate 110 is advanced between the first and second sets 260 and 262 of mating contacts 114 within the contact separation 266. The pluggable end 240 engages the contact heads 214 of the mating contacts 114. The mating contacts 114 are deflected away from an original position by the board substrate 110. The contact heads 214 slide along the corresponding engagement surfaces 202 and 204 until the plug connector 106 reaches a mating position or engagement with the receptacle connector 104. In the mating engagement, the contact heads 214 electrically interface with corresponding contact pads 218 of the board substrate 110 as shown in FIG. 3. In the exemplary embodiment, when the mating contacts 114 are deflected by the board substrate 110, the beam portions 212 provide a resilient engagement force toward the board substrate 110. The engagement force may facilitate maintaining an electrical engagement between the contact heads 214 and the corresponding contact pads 218.

Also shown in FIG. 3, the plug connector 106 may include a cable organizer 244 that couples to conductors 246 from the cable 156 (FIG. 2). The cable organizer 244 may be mechanically connected to the loading end 242 of the board substrate 110 and may also include conductor couplings 248 that electrically interconnect conductive pathways 220 of the board substrate 110 to the conductors 246. The cable organizer 244 may be located within the cavity 160 (FIG. 2) of the plug connector 106.

Figure 4:
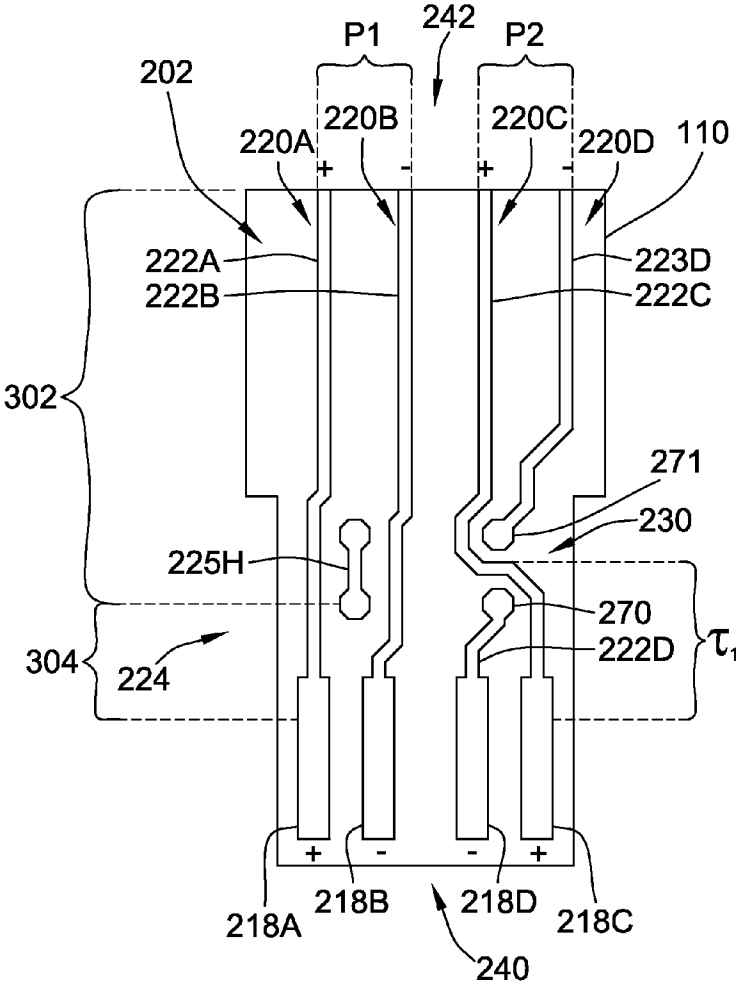
FIG. 4 is a plan view of a first engagement surface of the board substrate of FIG. 3.

FIGS. 4 and 5 illustrate plan views of the first and second engagement surfaces 202 and 204, respectively, of the board substrate 110. As shown, the board substrate 110 includes a plurality of differential pairs P1-P4 of conductive pathways 220A-220H that extend along the board substrate 110. When conductive pathways are near one another, crosstalk between the conductive pathways may be generated by capacitive and inductive coupling in which an exchange of electromagnetic energy occurs between the conductive pathways. The exchange of electromagnetic energy may affect a performance of the plug connector 106 (FIG. 1) in a desirable or an undesirable manner. Accordingly, in various embodiments, the differential pairs P1-P4 and corresponding conductive pathways 220A-220H are arranged with respect to each other to control the performance of the plug connector 106 and the connector assembly 102 (FIG. 1). For example, the conductive pathways 220A-220H may be arranged to provide at least one of crosstalk compensation and reduced return loss.

As shown in FIGS. 4 and 5, each of the conductive pathways 220A-220H has been labeled as (+) or (−). The labels (+) and (−) represent polarity of the corresponding conductive pathways. A conductive pathway labeled (+) is opposite in polarity to a conductive pathway labeled (−), and, as such, the conductive pathway labeled (−) carries a signal that is about 180° out of phase with the conductive pathway labeled (+). As shown, each differential pair P includes a pair of conductive pathways 220 (also referred to as first and second conductive pathways 220 of said differential pair) that carry a signal that is about 180° out of phase with the other conductive pathway of the differential pair.

Each conductive pathway 220 may include various features or components capable of transmitting a signal current therethrough. For example, as shown in FIG. 4, the conductive pathways 220A-220C include contact pads 218A-218C, respectively, and trace portions 222A-222C, respectively, that extend from the corresponding contact pad 218 proximate to the pluggable end 240 to the loading end 242. The trace portions 222A-222C connect with corresponding conductor couplings 248 (FIG. 3) proximate to the loading end 242. In the illustrated embodiment, the trace portions 222A-222C are located on the first engagement surface 202 and exposed to the surrounding environment. However, in alternative embodiments, the trace portions 222A-222C may at least partially extend within the board substrate 110 (e.g., between the dielectric layers of the board substrate 110).

Also shown, the conductive pathway 220D includes a contact pad 218D, trace portions 222D, 223D, and 225D (shown in FIG. 5), and a pair of vias 270 and 271. The trace portion 222D extends from the contact pad 218D to the via 270. The vias 270 and 271 extend through at least a portion of the thickness T (FIG. 3) from the first engagement surface 202 and toward the second engagement surface 204. In particular embodiments, the vias 270 and 271 extend entirely through the thickness T. The vias 270 and 271 are joined by the trace portion 225D. In the illustrated embodiment, the trace portion 225D extends along the second engagement surface 204. However, in alternative embodiments, the trace portion 225D may extend through a material or between layers of the board substrate 110. The trace portion 223D extends from the via 271 to the loading end 242 where the trace portion 223D connects with a corresponding conductor coupling 248 (FIG. 3).

As shown in FIG. 5, the conductive pathways 220E-220G include contact pads 218E-218G, respectively, and trace portions 222E-222G, respectively, that extend from the corresponding contact pad 218 proximate to the pluggable end 240 to the loading end 242. The trace portions 222E-222G connect with corresponding conductor couplings proximate to the loading end 242. In the illustrated embodiment, the trace portions 222E-222G are located on the second engagement surface 204 and exposed to the surrounding environment. However, in alternative embodiments, the trace portions 222E-222G may at least partially extend within the board substrate 110 (e.g., between the dielectric layers of the board substrate 110).

Also shown, the conductive pathway 220H includes a contact pad 218H, trace portions 222H, 223H, 225H (shown in FIG. 4), and a pair of vias 272 and 273. The trace portion 222H extends from the contact pad 218H to the via 272. The vias 272 and 273 extend through at least a portion of the thickness T (FIG. 3) from the second engagement surface 204 and toward the first engagement surface 202. In particular embodiments, the vias 272 and 273 extend entirely through the thickness T. The vias 272 and 273 are joined by the trace portion 225H. In the illustrated embodiment, the trace portion 225H extends along the first engagement surface 202. However, in alternative embodiments, the trace 225H may extend through a material or between layers of the board substrate 110. The trace portion 223H extends from the via 273 to the loading end 242 where the trace portion 223H connects with a corresponding conductor coupling 248 (FIG. 3).

In alternative embodiments, the conductive pathways may include other components or features that are capable of transmitting a signal current therethrough. For example, the conductive pathways may include one or more conductive flex circuits that interconnect different portions of the conductive pathway or connect the conductive pathway to the cable conductors or the mating contacts. Furthermore, the conductive pathways may include other components or features for controlling the performance of the plug connector 106 (FIG. 1). For example, the conductive pathways may include interstitial fingers that capacitively couple with one another.

As shown in FIG. 4, the differential pairs P1 and P2 may form a first set 224 of conductive pathways 220 that extends generally along the engagement surface 202. Likewise, the differential pairs P3 and P4 shown in FIG. 5 may form a second set 226 of conductive pathways 220 that extends generally along the engagement surface 204. As used herein, the phrase "extends generally along" includes the conductive pathways extending closer to the corresponding engagement surface for at least a majority of a path between the pluggable and loading ends 240 and 242. In particular embodiments, a conductive pathway may extend along and closer to a corresponding engagement surface except for one or more cross-overs that occur between the pluggable and loading ends 240 and 242.

In various embodiments, the conductive pathways 220 of the board substrate 110 may form one or more cross-overs in which one conductive pathway 220 crosses over another conductive pathway 220 thereby changing an arrangement of the conductive pathways 220 with respect to each other. In particular embodiments, the conductive pathways 220 of at least one differential pair P form a cross-over such that the conductive pathways 220 of the plurality of differential pairs P1-P4 have a first arrangement with respect to each other before the cross-over and a different second arrangement after the cross-over. By way of example, the conductive pathways 220C and 220D shown in FIG. 4 of the differential pair P2 may form a cross-over 230. In the cross-over 230, the conductive pathway 220D goes under the conductive pathway 220C. Likewise, the conductive pathways 220G and 220H shown in FIG. 5 of the differential pair P4 may form a cross-over 232. In the cross-over 232, the conductive pathway 220H goes under the conductive pathway 220G.

The cross-overs 230 and 232 effectively change positional relationships of the conductive pathways 220 with respect to each other. As shown in FIG. 4, the conductive pathways 220A-220D have a first arrangement 302 from the cross-over 230 to the loading end 242. In the first arrangement 302, the polarity of the conductive pathways is (+), (−), (+), (−). After the cross-over 230, the conductive pathways 220A-220D have a second arrangement 304 from the cross-over 230 to the pluggable end 240 in which the polarity of the conductive pathways 220A-220D is (+), (−), (−), (+). In the illustrated embodiment, the first arrangement 302 of conductive pathways 220A-220D generates a first crosstalk component when signal current flows through the conductive pathways 220A-220D, and the second arrangement 304 of conductive pathways 220A-220D generates a second crosstalk component when the signal current flows therethrough. The first and second crosstalk components of the conductive pathways 220A-220D may be configured to offset one another to, for example, reduce the unwanted effects of crosstalk and/or reduce return loss.

As shown in FIG. 5, the conductive pathways 220E-220H have a first arrangement 306 from the cross-over 232 to the loading end 242. In the first arrangement 306, the polarity of the conductive pathways is (+), (−), (+), (−). After the cross-over 232, the conductive pathways 220E-220H have a second arrangement 308 from the cross-over 232 to the pluggable end 240 in which the polarity of the conductive pathways 220E-220H is (+), (−), (−), (+). In the illustrated embodiment, the first arrangement 306 of conductive pathways 220E-220H generates a first crosstalk component when signal current flows through the conductive pathways 220E-220H and the second arrangement 308 of conductive pathways 220E-220H generates a second crosstalk component when the signal current flows therethrough. The first and second crosstalk components of the conductive pathways 220E-220H may be configured to offset one another to, for example, reduce the unwanted effects of crosstalk and/or reduce return loss.

In the exemplary embodiment, the first and second crosstalk components of the conductive pathways 220A-220D and the first and second crosstalk components of the conductive pathways 220E-220H may be configured with respect to each other to control the performance of the plug connector 106 and the connector assembly 102.

As shown in FIGS. 4 and 5, the first and second sets 224 and 226 of differential pairs P1-P4 have substantially matching patterns of conductive pathways 220 along the first and second engagement surfaces 202 and 204. The first set 224 of conductive pathways 220A-220D includes the cross-over 230, and the second set 226 of conductive pathways 220E-220H includes the second cross-over 232. As shown in FIGS. 4 and 5, the cross-over 230 may occur at an electrical time $\tau_1$ with respect to the contact pads 218D and 218C, and the cross-over 232 may occur at an electrical time $\tau_2$ with respect to the contact pads 218H and 218G. In the illustrated embodiment, the electrical times $\tau_1$ and $\tau_2$ are substantially equal such that the cross-overs 230 and 232 occur at a substantially common electrical time $\tau$.

Figures 6, 7:
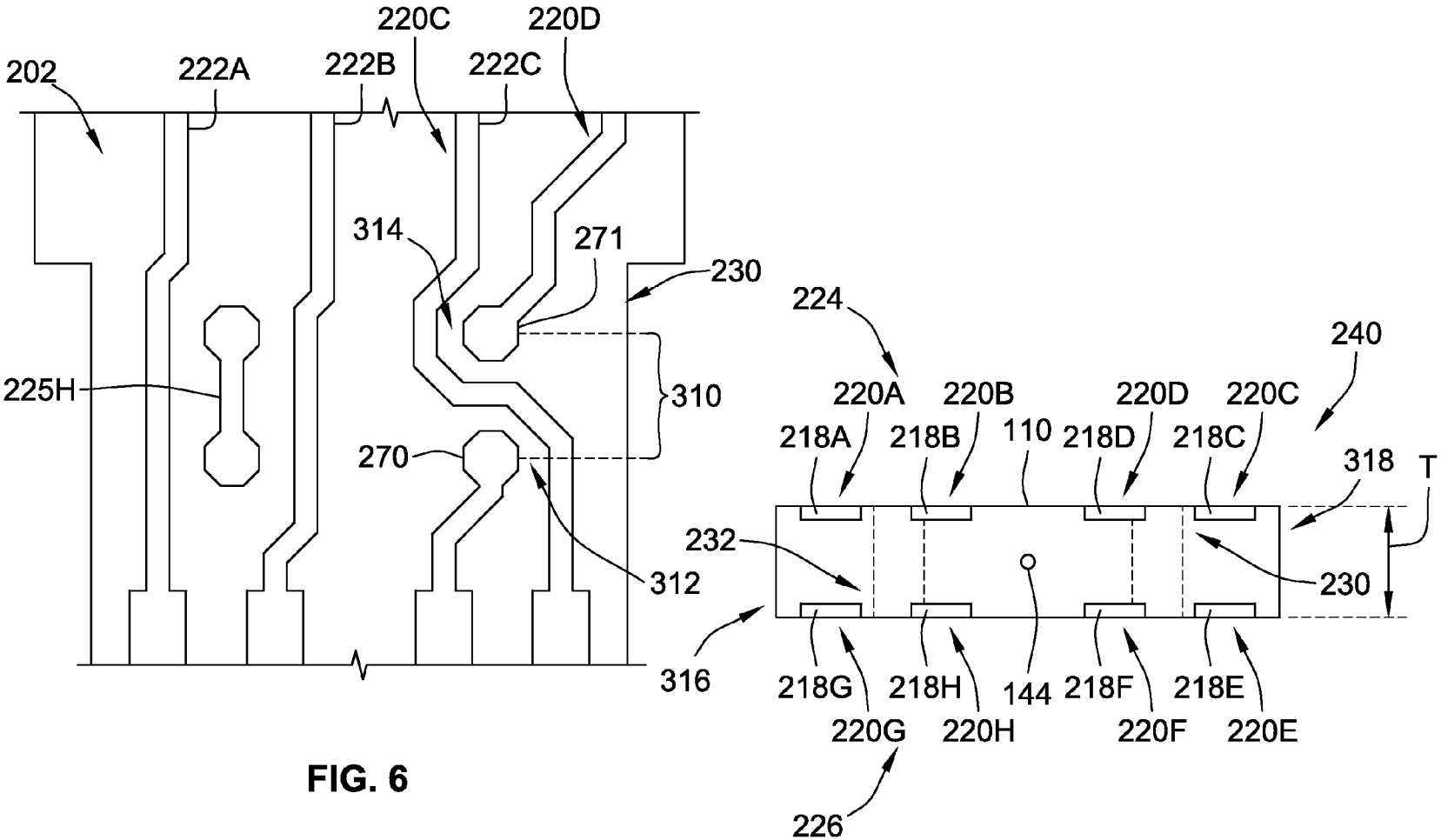
FIG. 6 is an enlarged plan view of the first engagement surface shown in FIG. 4.
FIG. 7 is a view of a pluggable end of the board substrate of FIG. 3.

FIG. 6 is an enlarged plan view of the first engagement surface 202. As described above, the first and second engagement surfaces 202 and 204 (FIG. 3) may have matching patterns of conductive pathways 220. Accordingly, the following description may be similarly applied to the second engagement surface 204. As shown in FIG. 6, the vias 270 and 271 may be separated by a via spacing 310. At the cross-over 230, the trace portion 222C of the conductive pathway 220C may extend between the vias 270 and 271 through the via spacing 310. In the illustrated embodiment, the trace portion 222C is equi-spaced from the vias 270 and 271 when extending therebetween. Also shown in FIG. 6, the trace portion 222C may have a uniform spacing from the conductive pathway 220D at the cross-over 230. More specifically, when the trace portion 222C extends around the via 270, a substantially uniform spacing 312 may exist therebetween. Similarly, when the trace portion 222C extends around the via 271, a substantially uniform spacing 314 may exist therebetween. Also shown in FIG. 6, the trace portion 225H may extend between and substantially parallel to the trace portions 222A and 222B along the first engagement surface 202.

FIG. 7 is a view of the pluggable end 240 of the board substrate 110 illustrating the first set 224 of conductive pathways 220A-220D and the second set 226 of conductive pathways 220E-220H with respect to each other. In the exemplary embodiment, the first and second sets 224 and 226 of conductive pathways 220 electromagnetically couple with each other through the thickness T of the board substrate 110 thereby affecting the crosstalk components of the conductive pathways 220A-220D and 220E-220H. The electromagnetic coupling may occur between different trace portions and may also occur between different vias. As shown, the cross-overs 230 and 232 exist proximate to opposite side surfaces 316 and 318 of the board substrate 110. The contact pads 218A, 218B, 218D, and 218C are substantially vertically aligned with the contact pads 218G, 218H, 218F, and 218E, respectively. Accordingly, in the illustrated embodiment, if the board substrate 110 were to be rotated 180° about the longitudinal axis 144, the configuration of the conductive pathways 220 would be the same.

It is to be understood that the above description is intended to be illustrative, and not restrictive. For example, the above-described embodiments (and/or aspects thereof) may be used in combination with each other. Furthermore, the board substrate 110 shown in FIGS. 3-7 is just one possible configuration of differential pairs P and conductive pathways 220. In alternative embodiments, the first and second sets 224 and 226 of conductive pathways 220 do not have matching patterns. Furthermore, the cross-overs 230 and 232 are not required to occur at a substantially common electrical time $\tau$.

In addition, the trace portions (e.g., trace portions 222A-222H, 223D, 225D, 223H, 225H) are illustrated in the Figures as extending alongside the engagement surfaces 202 and 204 of the board substrate 110. In alternative embodiments, trace portions may extend along different layers of the board substrate 110 such that the trace portions are between the engagement surfaces 202 and 204 within the board substrate 110. Furthermore, embodiments described herein may use various types of trace portions. For example, the trace portions may be rigid traces that are deposited along an engagement surface as shown in the Figures or deposited along different layers as described above. Alternatively, the trace portions may include flex circuits that are mounted between different sets of contacts. In addition, embodiments described herein may be used with various types of vias. For example, the vias may include blind vias, blind and buried vias, micro-vias (e.g., laser-drilled vias), and the like.

In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A plug connector comprising:

a plug body including a board substrate having at least one engagement surface that is configured to interface with mating contacts of a receptacle connector; and a plurality of differential pairs extending along the board substrate, the differential pairs comprising conductive pathways that include contact pads located on said at least one engagement surface, the contact pads being terminating ends of the conductive pathways that are configured to electrically engage the mating contacts of the receptacle connector, the conductive pathways of at least one differential pair forming a cross-over such that the conductive pathways of the plurality of differential pairs have a first arrangement with respect to each other before the cross-over and a different second arrangement after the cross-over;

wherein the first arrangement of conductive pathways generates a first crosstalk component and the second arrangement of conductive pathways generates a second crosstalk component when signal current flows through the conductive pathways, the first and second crosstalk components at least partially offsetting one another.

2. The plug connector in accordance with claim 1, wherein the conductive pathways of said at least one differential pair include first and second conductive pathways, the first conductive pathway including a pair of vias extending along the board substrate and being separated from each other by a via spacing, the second conductive pathway extending through the via spacing at the cross-over between the vias of the first conductive pathway.

3. The plug connector in accordance with claim 2, wherein the engagement surface is a first engagement surface and the board substrate includes a second engagement surface, the first and second engagement surfaces facing in opposite directions and having a thickness of the board substrate defined therebetween, the vias extending entirely through the thickness between the first and second engagement surfaces.

4. The plug connector in accordance with claim 2, wherein the engagement surface is a first engagement surface and the board substrate includes a second engagement surface, the vias being joined by a trace portion located on one of the first and second engagement surfaces.

5. The plug connector in accordance with claim 1, wherein the engagement surface is a first engagement surface and the board substrate includes a second engagement surface, the first and second engagement surfaces facing in opposite directions and having a thickness of the board substrate defined therebetween, each of the first and second engagement surfaces having at least two differential pairs of conductive pathways extending generally therealong.

6. The plug connector in accordance with claim 1, wherein the engagement surface is a first engagement surface and the board substrate includes a second engagement surface, the differential pairs of conductive pathways forming a first set of conductive pathways that extend generally along the first engagement surface and a second set of conductive pathways that extend generally along the second engagement surface.

7. The plug connector in accordance with claim 6, wherein the first and second sets of conductive pathways electromagnetically couple with each other through a thickness of the board substrate thereby affecting the first and second crosstalk components.

8. The plug connector in accordance with claim 6, wherein the first and second sets have substantially matching patterns of conductive pathways.

9. The plug connector in accordance with claim 6, wherein the cross-over includes first and second cross-overs, the first set of conductive pathways including the first cross-over and the second set of conductive pathways including the second cross-over.

10. The plug connector in accordance with claim 9, wherein the first and second cross-overs occur at a substantially common electrical time.

11. The plug connector in accordance with claim 1, wherein the plug body has a plurality of walls that define a cavity and an opening that provides access to the cavity, the board substrate being disposed within the cavity so that the mating contacts of the receptacle connector are received within the cavity and permitted to interface with said at least one engagement surface within the cavity.

12. A plug connector comprising:

a plug body including a board substrate having at least one engagement surface that is configured to interface with mating contacts of a receptacle connector; and a plurality of differential pairs extending along the board substrate, the differential pairs comprising conductive pathways that include contact pads located on said at least one engagement surface, the contact pads configured to electrically engage the mating contacts of the receptacle connector, the conductive pathways of at least one differential pair forming a cross-over such that the conductive pathways of the plurality of differential pairs have a first arrangement with respect to each other before the cross-over and a different second arrangement after the cross-over;

wherein the first arrangement of conductive pathways generates a first crosstalk component and the second arrangement of conductive pathways generates a second crosstalk component when signal current flows through the conductive pathways, the first and second crosstalk components at least partially offsetting one another;

wherein the engagement surface is a first engagement surface and the board substrate includes a second engagement surface having contact pads thereon, the first and second engagement surfaces facing in opposite directions and having a thickness of the board substrate defined therebetween.

13. A connector assembly comprising:

a receptacle connector having a plurality of mating contacts;

a plug connector configured to mate with the receptacle connector, the plug connector comprising:

a plug body including a board substrate having at least one engagement surface that is configured to interface with the mating contacts of the receptacle connector; and a plurality of differential pairs extending along the board substrate, the differential pairs comprising conductive pathways that include contact pads located on said at least one engagement surface, the contact pads having mating surfaces that extend substantially flush to said at least one engagement surface, the contact pads configured to electrically engage the mating contacts, the conductive pathways of at least one differential pair forming a cross-over such that the conductive pathways of the plurality of differential pairs have a first arrangement with respect to each other before the cross-over and a different second arrangement after the cross-over;

wherein the first arrangement of conductive pathways generates a first crosstalk component and the second arrangement of conductive pathways generates a second crosstalk component when signal current flows through the conductive pathways, the first and second crosstalk components at least partially offsetting one another;

wherein the mating contacts of the receptacle connector are configured to slidably interface with said at least one engagement surface and the contact pads when the plug and receptacle connectors are mated.

14. The connector assembly in accordance with claim 13, wherein the engagement surface is a first engagement surface and the board substrate includes a second engagement surface having contact pads thereon, the first and second engagement surfaces facing in opposite directions and having a thickness of the board substrate defined therebetween.

15. The connector assembly in accordance with claim 13, wherein the conductive pathways of said at least one differential pair include first and second conductive pathways, the first conductive pathway including a pair of vias extending along the board substrate and being separated from each other by a via spacing, the second conductive pathway extending through the via spacing at the cross-over between the vias of the first conductive pathway.

16. The connector assembly in accordance with claim 15, wherein the engagement surface is a first engagement surface and the board substrate includes a second engagement surface, the first and second engagement surfaces facing in opposite directions and having a thickness of the board substrate defined therebetween, the vias extending entirely through the thickness between the first and second engagement surfaces.

17. The connector assembly in accordance with claim 13, wherein the engagement surface is a first engagement surface and the board substrate includes a second engagement surface, the first and second engagement surfaces facing in opposite directions and having a thickness of the board substrate defined therebetween, the differential pairs of conductive pathways including a first set of differential pairs extending generally along the first engagement surface and a second set of differential pairs extending generally along the second engagement surface.

18. The connector assembly in accordance with claim 17, wherein the cross-over includes first and second cross-overs, the first set of differential pairs including the first cross-over and the second set of differential pairs including the second cross-over.

19. The connector assembly in accordance with claim 18, wherein the first and second cross-overs occur at a substantially common electrical time.

20. The connector assembly in accordance with claim 13, wherein the mating contacts include a first set of mating contacts and a second set of mating contacts that are spaced apart from the first set, the first and second sets of mating contacts having a contact separation extending therebetween, the board substrate moving within the contact separation between the mating contacts when the plug connector mates with the receptacle connector.

21. A connector assembly comprising:

a receptacle connector having a plurality of mating contacts;

a plug connector configured to mate with the receptacle connector, the plug connector comprising:

a plug body including a board substrate having at least one engagement surface that is configured to interface with the mating contacts of the receptacle connector; and a plurality of differential pairs extending along the board substrate, the differential pairs comprising conductive pathways that include contact pads located on said at least one engagement surface, the contact pads configured to electrically engage the mating contacts, the conductive pathways of at least one differential pair forming a cross-over such that the conductive pathways of the plurality of differential pairs have a first arrangement with respect to each other before the cross-over and a different second arrangement after the cross-over;

wherein the first arrangement of conductive pathways generates a first crosstalk component and the second arrangement of conductive pathways generates a second crosstalk component when signal current flows through the conductive pathways, the first and second crosstalk components at least partially offsetting one another;

wherein the mating contacts include contact heads that engage a pluggable end of the board substrate when the plug and receptacle connectors are mated, the contact heads being shaped to facilitate engagement with corresponding contacts pads of the board substrate.

22. The connector assembly in accordance with claim 21, wherein the contact heads are shaped to curve away from the board substrate, the mating contacts being deflected away from a relaxed position when the contact heads engage the board substrate.

* * * * *